US007805954B2

(12) United States Patent
Yamanaka et al.

(10) Patent No.: US 7,805,954 B2
(45) Date of Patent: Oct. 5, 2010

(54) HIGH-FREQUENCY CIRCUIT COOLING APPARATUS

(75) Inventors: Kazunori Yamanaka, Kawasaki (JP); Teru Nakanishi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 1594 days.

(21) Appl. No.: 10/947,539

(22) Filed: Sep. 23, 2004

(65) Prior Publication Data

US 2005/0257549 A1 Nov. 24, 2005

(30) Foreign Application Priority Data

May 19, 2004 (JP) ..... 2004-149618

(51) Int. Cl.
*F25D 23/12* (2006.01)

(52) U.S. Cl. ..... 62/259.2; 361/702; 361/707

(58) Field of Classification Search ..... 62/259.2, 62/259.1, 259.3, 259.4; 361/689, 701–702, 361/707–708

See application file for complete search history.

(56) References Cited

U.S. PATENT DOCUMENTS 3,946,141 A * 3/1976 Schmidt ..... 174/11 R
4,485,429 A * 11/1984 Mittal ..... 361/718
4,689,439 A * 8/1987 Sato ..... 174/15.4
5,447,033 A * 9/1995 Nagao et al. ..... 62/6
5,950,444 A * 9/1999 Matsunaga ..... 62/259.2
6,629,426 B2 * 10/2003 Paul et al. ..... 62/259.2
6,810,679 B2 * 11/2004 Odawara ..... 62/49.2
6,889,515 B2 * 5/2005 Tilton et al. ..... 62/259.2
2003/0019234 A1 * 1/2003 Wayburn et al. ..... 62/259.2
2003/0066829 A1 * 4/2003 Kansa et al. ..... 219/630
2003/0071300 A1 * 4/2003 Yashima et al. ..... 257/310

FOREIGN PATENT DOCUMENTS

JP 4-263768 9/1992
JP 2000-294399 10/2000
JP 2000-307306 11/2000

* cited by examiner

*Primary Examiner*—William E Tapolcai
(74) *Attorney, Agent, or Firm*—Krantz, Quintos & Hanson, LLP

(57) ABSTRACT

The high-frequency circuit cooling apparatus comprises a package container 14 for housing a high-frequency circuit, a tank 16 for storing a gas to be introduced into the package container 14, a cold head 12 for cooling the package container 14 and the tank 16, pipes 24, 26 connected to the tank 16, for supplying the gas into the tank 16, pipes 18, 22 detachably connected between the tank 16 and the package container 14, for introducing the gas in the tank 16 into the package container 14, and pipes 34, 36 detachably connected to the package container 14, for discharging the gas in the package container 14.

12 Claims, 5 Drawing Sheets

HIGH-FREQUENCY CIRCUIT COOLING APPARATUS

CROSS-REFERENCE TO RELATED APPLICATIONS

This application is based upon and claims priority of Japanese Patent Application No. 2004-149618, filed on May 19, 2004, the contents being incorporated herein by reference.

BACKGROUND OF THE INVENTION

The present invention relates to a high-frequency circuit cooling apparatus for cooling high-frequency circuits which operate at low temperatures, and high-frequency circuits which heat in operation, etc.

As high-frequency circuits which operate at low temperatures of below 100 K including 100 K, filters using oxide high temperature superconductors, such as YBCO, etc., low noise amplifiers comprising GaAs-based semiconductors, and others are known.

Among the high-frequency circuits which operate at such low temperatures, circuits treating higher power, such as superconducting transmission filters, etc., are required to have the interiors of the packages to be sufficiently cooled for being applied to mobile communication stations using the transmission band of frequencies of some GHz including some GHz. They are required to be mounted on cooling apparatuses which facilitate high-frequency circuit being replaced for maintenance. Furthermore, heating due to the quench of the superconductors is required to be quickly removed, and the thermal conduction is required to be changed in tests.

When a superconductor is cooled to a required temperature and has the superconducting state, heating of the superconductor at frequencies of about some GHz is lower by 1-2 placements or more than the normal conductor. On the other hand, high-frequency circuits using superconductors as the circuit conductors include, in many cases, members, such as electrodes, etc., formed of normal conductors. Heat is often conducted from the outside through cables, etc., and heat due to flow of current often inflows from connectors, cables, etc. Accordingly, the high-frequency circuits using superconductors as the circuit conductors are required to be sufficiently cooled.

The high-frequency circuits have been cooled by the following methods.

For example, the package container accommodating a high-frequency circuit is heat-contacted with the cold head of a freezer to cool the high-frequency circuit by thermal conduction.

A metal container to be filled with helium gas is provided with the cold head of a freezer, and a package container accommodating a high-frequency circuit is placed in the metal container. Further, the cold head and metal container is placed in a vacuum container. Helium gas is fed from outside of the vacuum container. In this state, the cold head cools the package container accommodating the high-frequency circuit.

A package container accommodating a high-frequency circuit is immersed in liquid nitrogen and liquid helium to cool the high-frequency circuit.

However, the conventional cooling method for high-frequency circuits have found it difficult to make sufficiently cooling the high-frequency circuits compatible with facilitating the replacement and maintenance of the high-frequency circuits.

Following references disclose the background art of the present invention.

[Patent Reference 1]

Japanese published unexamined patent application No. 2000-307306

[Patent Reference 2]

Japanese published unexamined patent application No. Hei 04-263768 (1992)

[Patent Reference 3]

Japanese published unexamined patent application No. 2000-294399

SUMMARY OF THE INVENTION

An object of the present invention is to provide a high-frequency circuit cooling apparatus which can not only sufficiently cool high-frequency circuits, but also facilitates replacing and maintaining the high-frequency circuits.

According to one aspect of the present invention, there is provided a high-frequency circuit cooling apparatus comprising: a package container for housing a high-frequency circuit; a tank for storing a gas to be introduced into the package container; a cooling unit for cooling the package container and the tank; a first pipe connected to the tank, for supplying the gas into the tank; a second pipe detachably connected between the tank and the package container, for introducing the gas in the tank into the package container; and a third pipe detachably connected to the package container, for discharging the gas in the package container.

The high-frequency circuit cooling apparatus according to the present invention comprises: a package container for housing a high-frequency circuit; a tank for storing a gas to be introduced into the package container; a cooling unit for cooling the package container and the tank; a first pipe connected to the tank, for supplying the gas into the tank; a second pipe detachably connected between the tank and the package container, for introducing the gas in the tank into the package container; and a third pipe detachably connected to the package container, for discharging the gas in the package container, whereby the high-frequency circuit housed in the package container can be sufficiently cooled, and facilitate the replacement and maintenance of the high-frequency circuit housed in the package container.

DETAILED DESCRIPTION OF THE INVENTION

A First Embodiment

Figure 1:
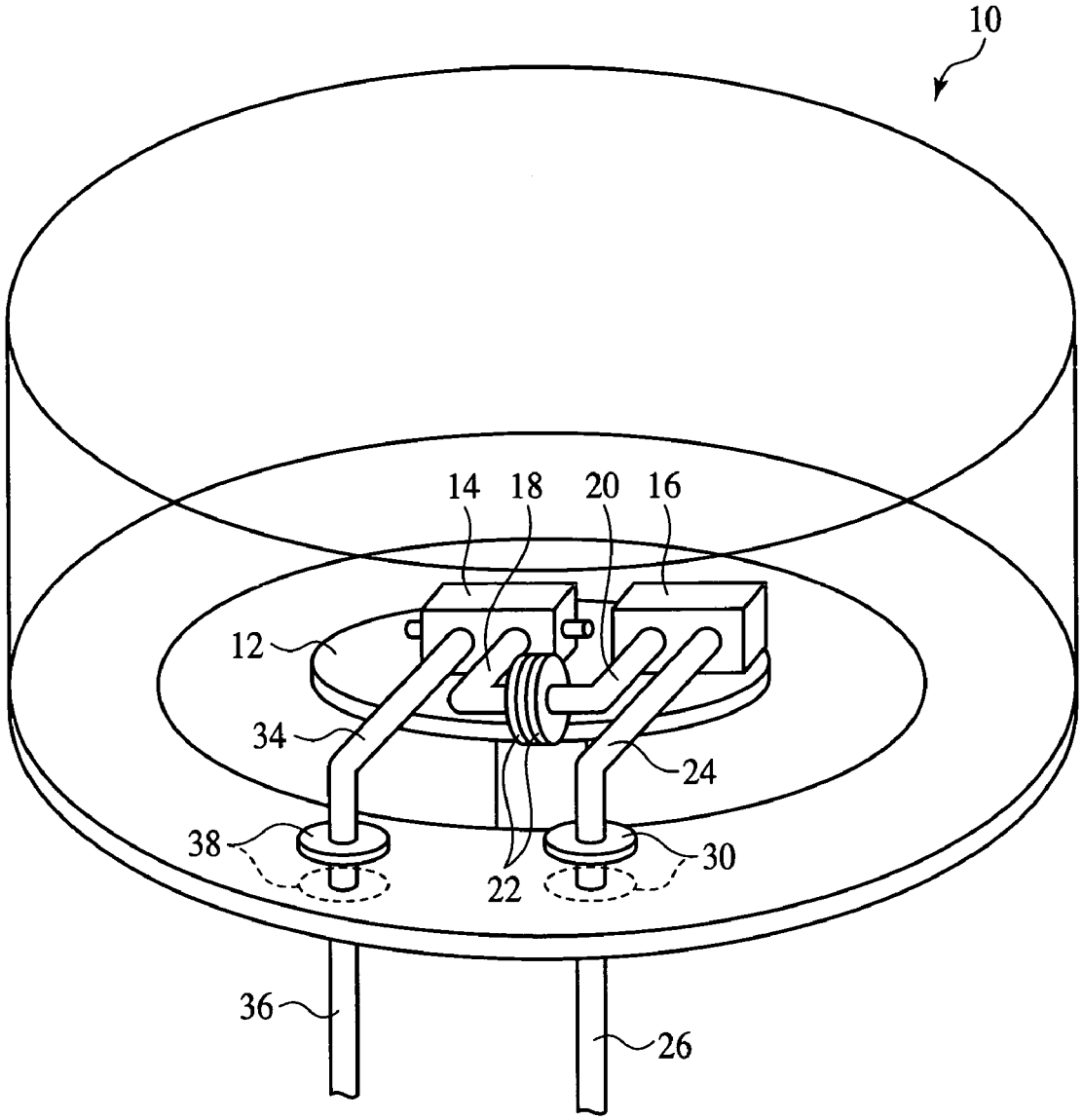
FIG. 1 is a perspective view of the high-frequency circuit cooling apparatus according to a first embodiment of the present invention, which illustrates a structure thereof.
Figure 2:
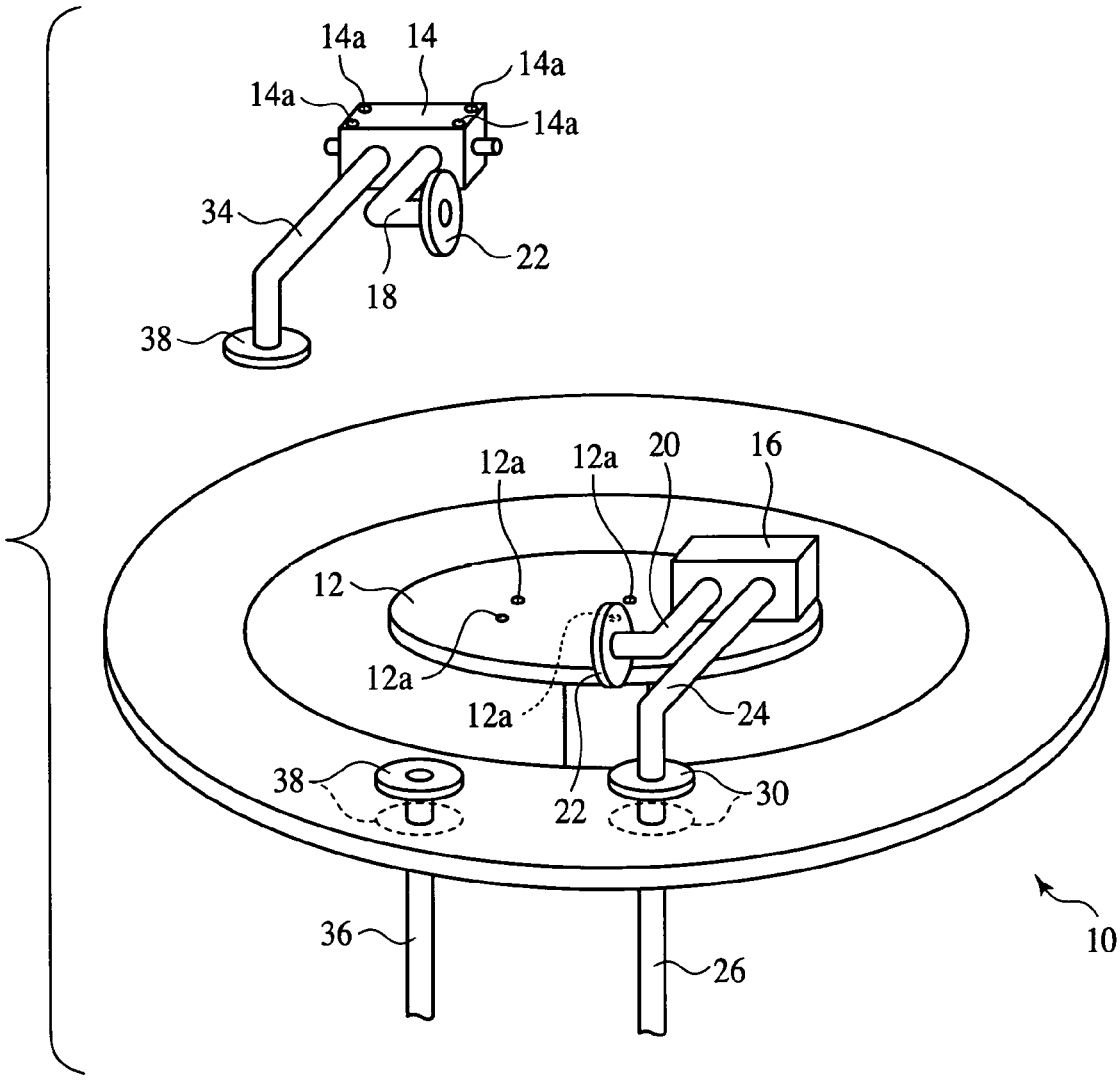
FIG. 2 is a perspective view of the high-frequency circuit cooling apparatus according to the first embodiment of the present invention with the package container dismounted, which illustrates the structure thereof.
Figure 3:
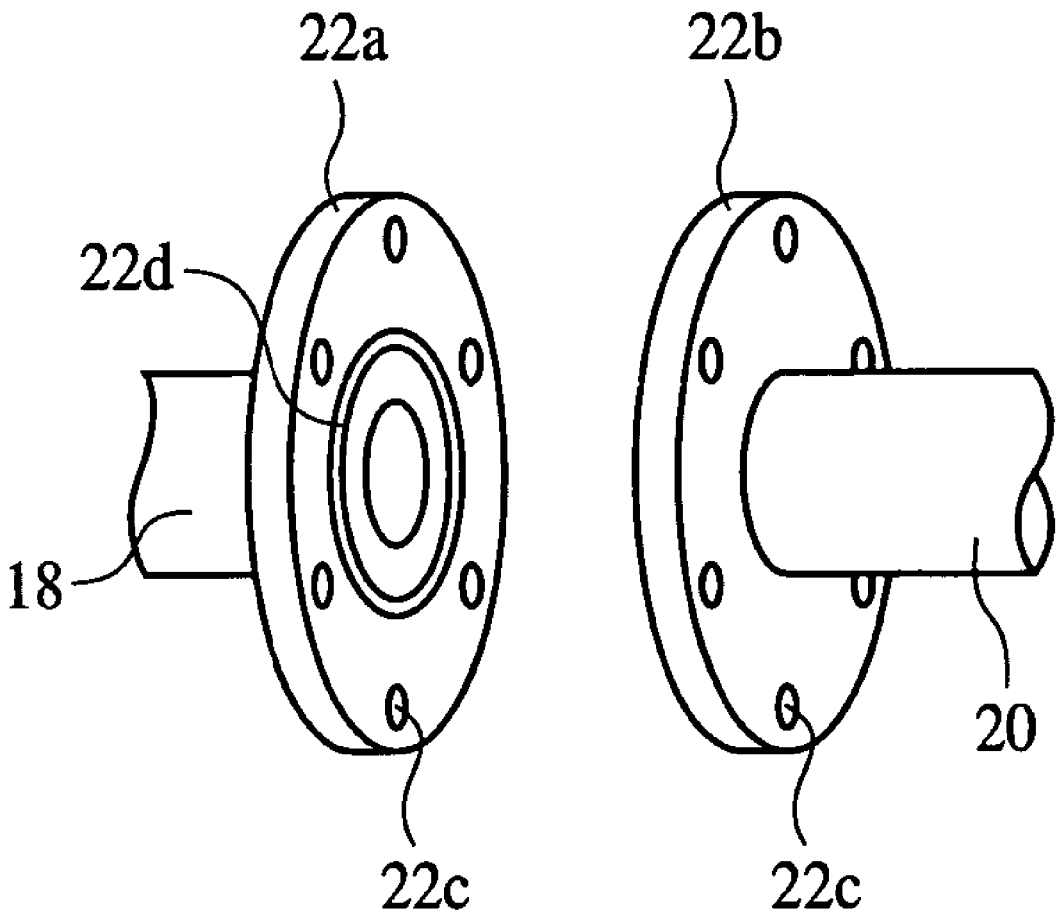
FIG. 3 is a diagrammatic view of the pipe connection of the high-frequency circuit cooling apparatus according to the first embodiment of the present invention, which illustrates a metal seal thereof.

The high-frequency cooling apparatus according to a first embodiment of the present invention will be explained with reference to FIGS. 1 to 3. FIG. 1 is a perspective view of the high-frequency circuit cooling apparatus according to the present embodiment, which illustrates a structure thereof. FIG. 2 is a perspective view of the high-frequency circuit cooling apparatus according to the present invention with the package container dismounted, which illustrates the structure thereof. FIG. 3 is a diagrammatic view of the pipe connection of the high-frequency circuit cooling apparatus according to the present embodiment of the present invention, which illustrates a metal seal thereof.

As illustrated, a cold head 12 of a freezer is disposed in a vacuum container 10. A vacuum pump (not illustrated) for evacuating the interior of the vacuum container 10 to a vacuum state is connected to the vacuum container 10.

In the vacuum container 10, a package container 14 accommodating a high-frequency circuit, and a tank 16 storing helium gas to be fed into the package container 14 are respectively mounted on the cold head 12. The package container 14 on the cold head 12 is screwed to the cold head 12. The package container 14 and the tank 16 are in communication with each other through a pipe 18 connected to the package container 14 and a pipe 20 connected to the tank 16. The connection between the package container 14 and the pipe 18 is sealed with a metal seal (not illustrated). The connection between the tank 16 and the pipe 20 is sealed with a metal seal (not illustrated). The connection between the pipe 18 and the pipe 20 is sealed with a metal seal 22.

Pipes 24, 26 for supplying helium gas into the tank 16 are connected to the tank 16. The pipe 24 is disposed between the tank 16 and the inside of a pipe connection hole formed in the wall of the vacuum container 10. The connection between the tank 16 and the pipe 24 is sealed with a metal seal (not illustrated). The connection between the pipe 24 and the pipe connection hole is sealed with a metal seal 30. The pipe 26 is connected to the outside of the pipe connection hole to the inside of which the pipe 24 is connected. The metal seal 30 seals the connection between the pipe connection hole and the pipe 26. Thus, the pipe 24 and the pipe 26 are connected to each other, and the connection between them is sealed with the metal seal 30.

Pipes 34, 36 for discharging the helium gas out of the package container 14 are connected to the package container 14. The pipe 34 is disposed between the package container 14 and the inside of a pipe connection hole formed in the wall of the vacuum container 10. The connection between the package container 14 and the pipe 34 is sealed with a metal seal (not illustrated). The pipe 34 and the pipe connection hole is sealed with a metal seal 38. The pipe 36 is connected to the outside of the pipe connection hole to the inside of which the pipe 34 is connected. The metal seal 38 seals the interconnection between the pipe 36 and the pipe connection hole. Thus, the pipe 34 and the pipe 36 are connected to each other, and the connection between them is sealed with the metal seal 38.

The pipe 34 connected to the package container 14 is detachably connected to the inside of the pipe connection hole formed in the wall of the vacuum container 10. The pipe 14 connected to the package container 14 is detachably connected to the pipe 20. In the high-frequency circuit cooling apparatus according to the present embodiment, the package container 14 can be detached as illustrated in FIG. 2 by disconnecting the pipe 34 from the pipe connection hole, disconnecting the pipe 18 from the pipe 20 and disengaging the screws securing the package container 14 to the cold head 12. The package container 14 is screwed to the cold head 12 by engaging screws screwed through-holes 14*a* formed in the package container 14 and screwed through-holes 12*a* formed in the cold head 12.

The structure of the metal seal at the connections of the respective pipes will be explained with reference to FIG. 3 and by means of the metal seal 22 at the connection between the pipe 18 and the pipe 20.

As illustrated, metal flanges 22*a*, 22*b* are provided at the ends of the pipes 18, 20. Holes 22*c* for screws for fixing the metal flanges 22*a*, 22*b* to each other are provided in the metal flanges 22*a*, 22*b*. A groove 22*d* for fixing a metal gasket for retaining air tightness is provided in the surface of the metal flange 22*a*, which is to contact with the metal flange 22*b*. The same groove (not illustrated) is provided also in the surface of the metal flange 22*b*, which is to contact with the metal flange 22*a*. In the case where a ConFlat type-copper gasket is used as the metal gasket, edge-shaped grooves for fixing the metal gasket must be formed both in the metal flanges 22*a*, 22*b*. In the case where an O-ring seal of indium is used, a groove of a shape for fixing the O-ring may be formed in either of the metal flanges 22*a*, 22*b*.

The metal seals other than the metal seal 22 at the connection between the pipe 18 and the pipe 20 has substantially the same structure.

Thus, the high-frequency circuit cooling apparatus according to the present embodiment is constituted.

The high-frequency circuit cooling apparatus according to the present embodiment is characterized in that the pipe 18 for feeding helium gas and the pipe 34 for discharging the helium gas are connected to the package container 14 accommodating a high-frequency circuit so as to feed helium gas into the package container 14.

Helium gas fed into the package container 14 cools a high-frequency circuit housed in the package container 14 by solid heat conduction by the cold head 12 via the package container 14 and also by the heat conduction of the helium gas. Thus, the high-frequency circuit housed in the package container 14 can be sufficiently cooled. In the case that the high-frequency circuit includes a superconductor as the circuit conductor, heating due to the quench can be quickly removed, and the thermal runaway of the circuit can be prevented.

The supply amount of helium gas to be supplied into the package container 14 through the tank 16 is suitably adjusted to thereby control the heat transmission to the high-frequency circuit housed in the package container 14. Thus, in, e.g., tests, etc. of the high-frequency circuit, the cooling temperature and the cooling rate for the high-frequency circuit can be adjusted.

The high-frequency circuit cooling apparatus according to the present embodiment is characterized in that the apparatus includes the tank 16 mounted on the cold head 12, for storing helium gas to be fed into the package container 14.

The helium gas stored in the tank 16 is cooled by solid heat conduction of the cold head 12 through the tank 16, and the helium gas which has been sufficiently cooled in advance can be fed into the package container 14. Accordingly, the high-frequency circuit housed in the package container 14 can be sufficiently cooled in a short time.

Furthermore, the high-frequency circuit cooling apparatus according to the present embodiment is characterized also in that the package container 14 mounted on the cold head 12 is detachable.

The package container 14, which is detachable from the cold head 12, can be suitably taken out of the vacuum container 10 as required, which facilitates the replacement and maintenance of the high-frequency circuit housed in the package container 14.

A Second Embodiment

Figure 4:
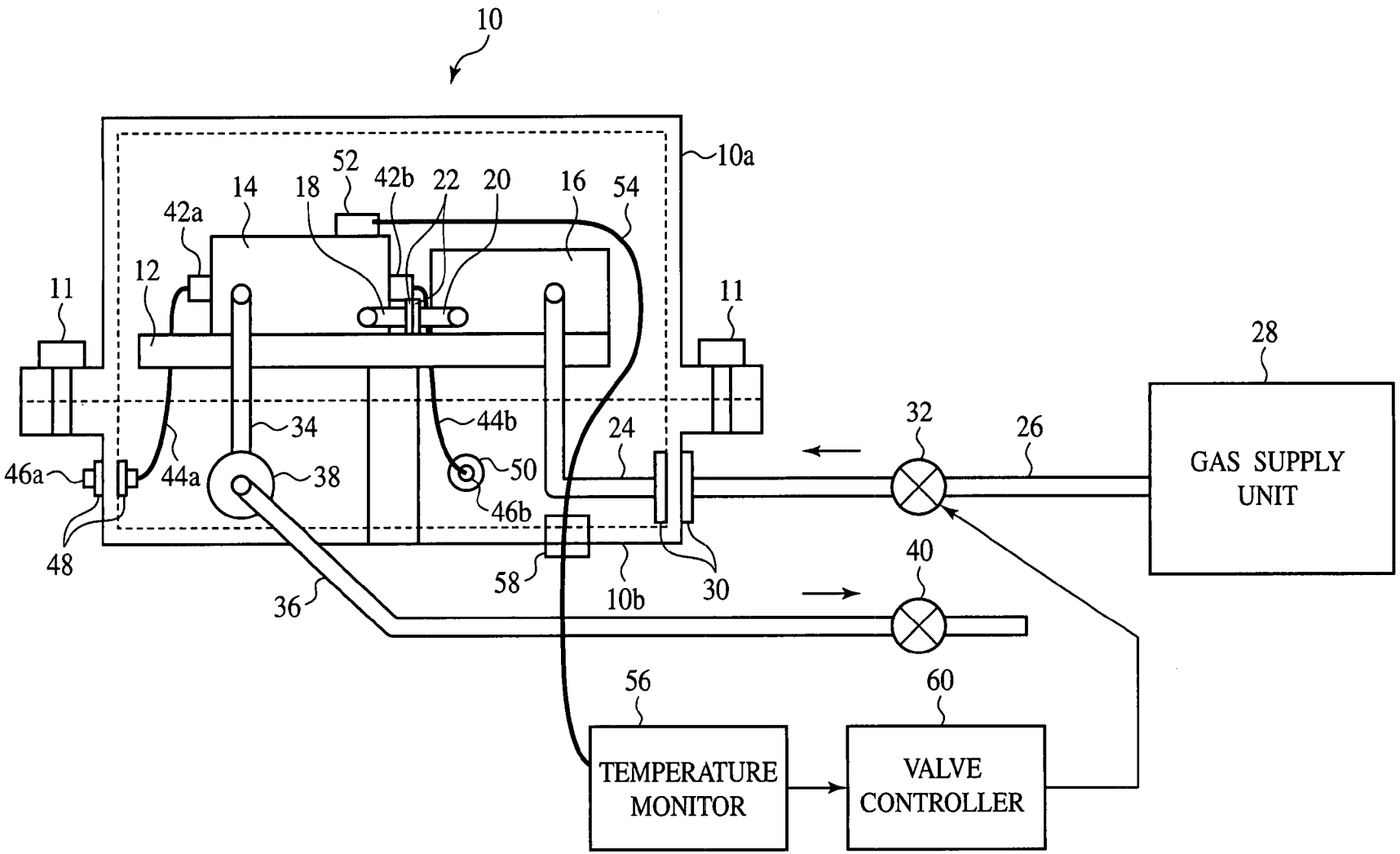
FIG. 4 is a sectional view of the high-frequency circuit cooling apparatus according to a second embodiment of the present invention, which illustrates a structure thereof.
Figure 5A:
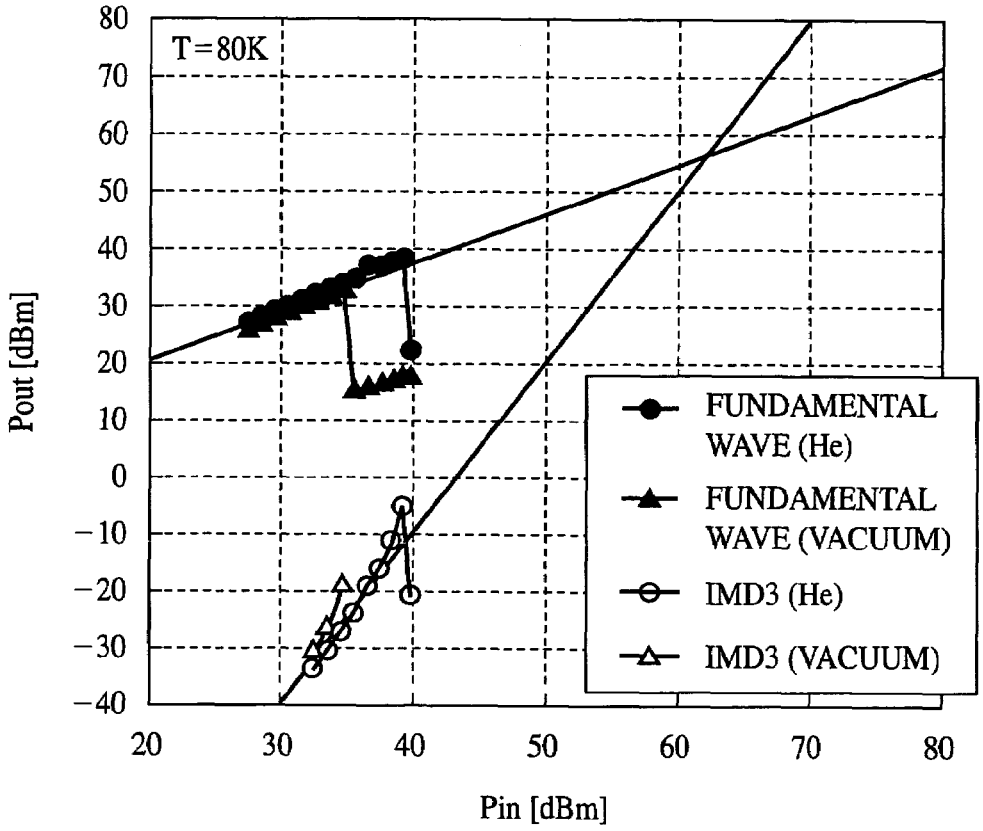
FIG. 5A is a graph of the results of power tests made on a high-frequency circuit operated while being cooled by the high-frequency circuit cooling apparatus according to the second embodiment of the present invention.
Figure 5B:
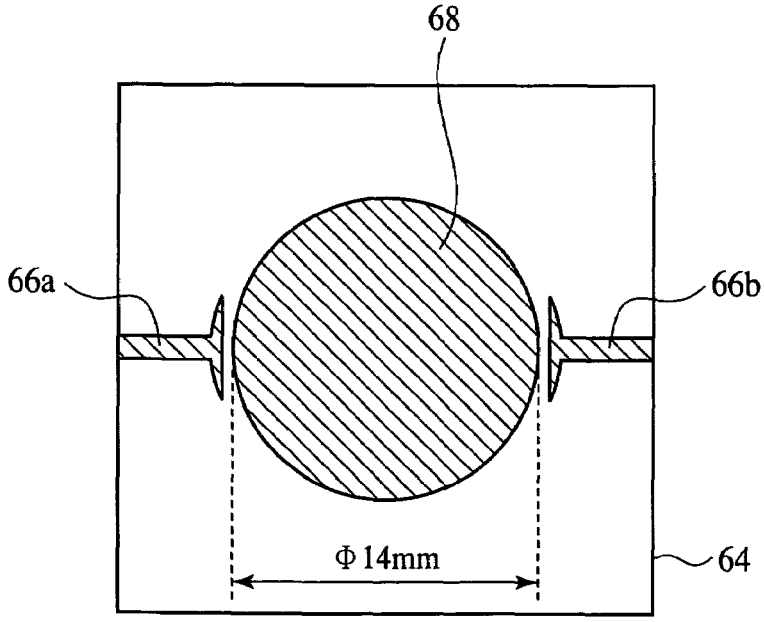
FIG. 5B is a plan view of the high-frequency circuit the power tests were made on, which illustrates a structure thereof.

The high-frequency circuit cooling apparatus according to a second embodiment will be explained with reference to FIGS. 4 and 5. FIG. 4 is a sectional view of the high-frequency circuit cooling apparatus according to the present embodiment, which illustrates a structure thereof. FIG. 5A is a graph of the results of power tests made on a high-frequency circuit operated while being cooled by the high-frequency circuit cooling apparatus according to the second embodiment of the present invention. FIG. 5B is a plan view of the high-frequency circuit the power tests were made on, which illustrates a structure thereof.

First, the general structure of the high-frequency circuit cooling apparatus according to the preset embodiment will be explained with reference to FIG. 4.

As illustrated, a cold head 12 of a freezer is disposed in a vacuum container 10. A vacuum pump (not illustrated) for evacuating the interior of the vacuum container 10 to a vacuum state is connected to the vacuum container 10.

In the vacuum container 10, a package container 14 accommodating a high-frequency circuit, and a tank 16 storing helium gas to be fed into the package container 14 are respectively mounted on the cold head 12. The package container 14 and the tank 16 are in communication with each other through a pipe 18 connected to the package container 14 and a pipe 20 connected to the tank 16. The connection between the package 14 and the pipe 18 is sealed with a metal seal (not illustrated). The connection between the tank 16 and the pipe 20 is sealed with a metal seal (not illustrated). The connection between the pipe 18 and the pipe 20 is sealed with a metal seal 22.

A gas supply unit 28 for supplying helium gas into the tank 16 is connected to the tank 16 through pipes 24, 26. The pipe 24 is disposed between the tank 16 and the inside of a pipe connection hole formed in the wall of the vacuum container 10. The connection between the tank 16 and the pipe 24 is sealed with a metal seal (not illustrated). The connection between the pipe 24 and the pipe connection hole is sealed with a metal seal 30. The pipe 26 is connected to the outside of the pipe connection hole to the inside of which the pipe 24 is connected. The metal seal 30 seals the connection between the pipe connection hole and the pipe 26. Thus, the pipe 24 and the pipe 26 are connected to each other, and the connection between them is sealed with the metal seal 30. An electromagnetic valve 32 is inserted in the pipe 26.

Pipes 34, 36 for discharging the helium gas out of the package container 14 are connected to the package container 14. The pipe 34 is disposed between the package container 14 and the inside of a pipe connection hole formed in the wall of the vacuum container 10. The connection between the package container 14 and the pipe 34 is sealed with a metal seal (not illustrated). The pipe 34 and the pipe connection hole is sealed with a metal seal 38. The pipe 36 is connected to the outside of the pipe connection hole to the inside of which the pipe 34 is connected. The metal seal 38 seals the connection between the pipe 36 and the pipe connection hole. Thus, the pipe 34 and the pipe 36 are connected to each other, and the connection between them is sealed with the metal seal 38. A valve 40 is inserted in the pipe 36.

On the package container 14 there are provided high-frequency coaxial connectors 42*a*, 42*b* for inputting and outputting high-frequency signals to and from the high-frequency circuit housed in the package container 14. The high-frequency coaxial connector 42*a* is connected to a high-frequency coaxial connector 46*a* provided on the wall of the vacuum container 10 via a high-frequency coaxial cable 44*a*. The high-frequency coaxial connector 46*a* is sealed by a hermetic sealing 48. The high-frequency coaxial connector 42*b* is connected to a high-frequency coaxial connector 46*b* provided on the wall of the vacuum container 10 via a high-frequency coaxial cable 44*b*. The high-frequency coaxial connector 46*b* is sealed by a hermetic sealing 50.

Furthermore, a temperature sensor 52 is attached to the package container 14. The temperature sensor 52 is connected to a temperature monitor 56 which monitors output signals from the temperature sensor 52 via a line 54. The portion of the wall of the vacuum container 10, where the line 54 interconnecting the temperature sensor 52 and the temperature monitor 56 is led out is sealed by a hermetic sealing 58.

The temperature monitor 56 is connected to a valve controller 60 which controls the opening and closure of the electromagnetic valve 32 inserted in the pipe 26, based on results of the monitor by the temperature monitor 56.

Thus, the high-frequency circuit cooing apparatus according to the present embodiment is constituted. The respective members of the high-frequency circuit cooling apparatus according to the present embodiment will be detailed.

The vacuum container 10 has the interior evacuated by the vacuum pump to a vacuum state to insulate the package container 14 and the tank 16 housed inside from the outside, whereby the efficiency of cooling the package container 14 and the tank 16 by the cold head 12 can be improved. As exemplified in FIG. 4, the vacuum container 10 comprises an upper part 10*a* and a lower part 10*b* fixed to each other by a screw 11 for vacuum seal. The vacuum container 10 having the upper part 10*a* and the lower part 10*b* made separable facilitates the members housed in the vacuum container 10 being replaced and maintained.

The cold head 12 can be cooled to a temperature of, e.g., below 100 K including 100 K, which is the operation temperature of the high-frequency circuit. The cold head 12 cools the package container 14 mounted on the cold head 2 and cools the high-frequency circuit housed in the package container 14. The cold head 12 cools the tank 16 and cools helium gas stored in the tank 16.

The package container 14 and the tank 16 are mounted on the cold head 12 with a heat conductive solid medium disposed therebetween. The heat conductive solid medium can be, e.g., hydrocarbon-based grease, indium sheet, graphite or others. Silicone greases, which cracks when cooled to low temperatures of below 100 K including 100 K, which are the operation temperatures of the high-frequency circuit, is not suitable as the solid medium for improving the cooling efficiency.

The package container 14 and the tank 16 mounted on the cold head 12 with the heat conductive solid medium therebetween are detachably secured mechanically by means of screws or others.

In the package container 14, a transmission superconducting band-pass filter having a pass frequency of, e.g., around a 4 GHz band is housed as the high-frequency circuit. The size of the package container 14 has, e.g., an about 3 cm-height, a 5 cm-length and a 3 cm-width. The package container 14 can be formed of, e.g., copper, aluminum, aluminum alloy, iron-nickel base alloy or others. The package container 14 may be formed of alumina, zirconia, partially stabilized zirconia, stabilized zirconia. In the case where the package container 14 is formed of ceramics, a metal film of, e.g., gold, silver, copper or others is formed on the inside wall of the package container 14. The package container 14 formed of the metal material or the ceramics with the metal film formed on the inside wall shuts off the outside electromagnetic waves, which affect the high-frequency circuit.

The package container 14 is separable into a plurality of members so that a high-frequency circuit can be housed and can be taken out. The plural members are secured to each other mechanically by screws, etc. Metal seals of, e.g., indium, copper, aluminum, gold or others are provided between the plural members. Thus, the package container 14 is made air-tight. The structure of the package container 14, which is separable into the plural members, facilitates the replacement and maintenance of the high-frequency circuit housed in the package container 14.

As will be described later, helium gas stored and cooled in the tank 16 is fed into the package container 14 through the pipes 20, 18. The helium gas thus fed into the package container 14 directly cools the high-frequency circuit housed in the package container 14.

The pipe 34 in the vacuum container 10 is detachably connected to the package container 14. The connection between the pipe 34 and the package container 14 are sealed with a metal seal (not shown). The pipe 34 connected to the package container 14, which is in the vacuum container 10, and the pipe 36 outside the vacuum container 10 are connected detachably at the pipe connection hole formed in the wall of the vacuum container 10. The connection between the pipe 34 and the pipe 36 is sealed with a metal seal 38. The metal seal (not illustrated) at the connection between the pipe 34 and the package container 14, and the metal seal 38 are of, e.g., ICF type, and their material can be indium, copper, aluminum, gold or others.

The tank 16 stores helium gas supplied from the gas supply unit 28 through the pipes 26, 24. The helium gas stored in the tank 16 is cooled to a prescribed temperature by the cold head 12. Fins are provided in the tank 16 for a large heat conduction area, so that the helium gas stored in the tank 16 can be cooled efficiently. The helium gas stored in the tank 16 is caused to go into the package container 14 through the pipe 20, 18 by helium gas newly supplied from the gas supply unit 28 into the tank 16.

The pipe 24 in the vacuum container 10 is detachably connected to the tank 16. The connection between the pipe 24 and the tank 16 is sealed with a metal seal (not illustrated). The pipe 24 connected to the tank 16, which is in the vacuum container 10, and the pipe 26 connected to the gas supply unit 28, which is outside the vacuum container 10, are connected detachably at the pipe connection hole formed in the wall of the vacuum container 10. The connection between the pipe 24 and the pipe 26 is sealed with a metal seal 30. The metal seal (not illustrated) at the connection between the pipe 24 and the tank 16, and the metal seal 30 are of, e.g., ICF type, and their material can be indium, copper, aluminum, gold or others.

The pipe 18 connected to the package container 14, and the pipe 20 connected to the tank 16 are detachably connected to each other. The connection between the pipe 18 and the pipe 20 are sealed with a metal seal 22. The pipe 18 is detachably connected to the package container 14. The connection between the pipe 18 and the package container 14 is sealed with a metal seal (not illustrated). The pipe 20 is detachably connected to the tank 16. The connection between the pipe 20 and the tank 16 is sealed with a metal seal (not illustrated). the metal seal (not illustrated) at the connection between the pipe 18 and package container 14, the metal seal (not illustrated) at the connection between the pipe 20 and the tank 16, and the metal seal 22 are of, e.g., ICF type, and their material can be indium, copper, aluminum, gold or others.

The gas supply unit 28 supplies helium gas into the tank 16 through the pipes 26, 24. The gas supply unit 28 can adjust the pressure of the gas to be supplied into the tank 16 to be in the range of, e.g., $10^{-3}$ Torr ~1 atmospheric pressure. The helium gas to be supplied by the gas supply unit 28 has, e.g., the room temperature. The start and stop of the supply of helium gas from the gas supply unit 28 into the tank 16, and the supply amount of helium gas are controlled by the opening and closure of the electromagnetic valve 32 inserted in the pipe 26.

The temperature sensor 52 is, e.g., a four-wire temperature sensor, and detects temperatures of the package container 14 and outputs the detected signals to the temperature monitor 56.

The temperature monitor 56 monitors temperatures of the package container 14, based on output signals from the temperature sensor 52, and outputs the monitored results to the valve controller 60.

The valve controller 60 controls the opening and closure of the electromagnetic valve 32 inserted in the pipe 26, based on the monitored results of temperatures of the package container 14 by the temperature monitor 56. Thus, the start and stop, and the amount of the supply of helium gas from the gas supply unit 28 into the tank 16 are controlled.

The high-frequency circuit cooling apparatus according to the present embodiment is characterized in that the pipe 18 for supplying helium gas and the pipe 34 for discharging the helium gas are connected to the package container 14 housing a high-frequency circuit, so that the helium gas is supplied into the package container 14.

Helium gas is supplied into the package container 14, whereby the high-frequency circuit housed in the package container 14 is cooled not only by the solid thermal conduction by the cold head 12 via the package container 14, but also by the heat conduction of the helium gas. Thus, the high-frequency circuit housed in the package container 14 can be sufficiently cooled. In the high-frequency circuit using superconductor as the circuit conductor, the heat due to quench can be quickly removed, and the thermal runaway of the circuit can be prevented.

The high-frequency circuit cooling apparatus according to the present embodiment can sufficiently cool the high-frequency circuit, whereby when a superconducting band-pass filter is operated while being cooled by the high-frequency circuit cooling apparatus according to the present embodiment can have good filter characteristics. Even when input signals of higher power are inputted, good filter characteristics can be obtained in comparison with the case where the interior of the package container is placed in a vacuum state.

The supply amount of helium gas to be supplied from the gas supply unit 28 into the package container 14 via the tank 16 is suitably controlled to adjust the heat conduction to the high-frequency circuit housed in the package container 14. Thus, the cooling temperature and cooling rate of the high-frequency circuit can be adjusted in, e.g., tests of the high-frequency circuit.

The high-frequency circuit cooling apparatus according to the present embodiment is characterized also in that the apparatus includes the tank 16 mounted on the cold head 12, for storing helium gas fed into the package container 14.

The helium gas stored in the tank 16 is cooled by the solid heat conduction of the cold head 12 via the tank 16, whereby the helium gas can be sufficiently cooled in advance to be fed into the package container 14. Accordingly, the high-frequency circuit can be sufficiently cooled in a short time.

Furthermore, the high-frequency circuit cooling apparatus according to the present embodiment is characterized also in that the package container 14 comprises a plurality of members mechanically fixed to each other which are separable, and the pipes 18, 34 are detachably connected to the package container 14, and the pipes 20, 36 are detachably connected respectively thereto.

Accordingly, the pipes 18, 34 are detached from the package container 14, or the pipes 18, 34 are detached from the pipes 20, 36, and the package container 14 is separated into the plural members, whereby the high-frequency circuit housed in the package container 14 can be easily replaced or maintained.

Then, the operation of the high-frequency circuit cooling apparatus according to the present embodiment will be explained with reference to FIG. 4.

First, with the electromagnetic valve 32 and the valve 40 opened, helium gas is supplied from the gas supply unit 28 into the tank 16 via the pipes 26, 24 and into the package container 14 connected to the tank 16 via the pipes 20, 18, whereby the gas which has filled the package container 14 before the helium gas is supplied is discharged outside through the pipes 34, 36, and the interior of the package container 14 is replaced by the helium gas.

After the tank 16 and the package container 14 are filled with the helium gas, the electromagnetic valve 32 and the valve 40 are temporarily closed.

Then, the interior of the vacuum container 10 is evacuated by the vacuum pump into a vacuum state of a prescribed vacuum degree.

Then, the cooling by the cold head 12 is started. The package container 14 is cooled by the heat conduction of the cold head 12, and the high-frequency circuit and the helium gas in the package container 14 goes on being cooled. The tank 16 is cooled and, the helium gas in the tank 16 is cooled.

Thus, the high-frequency circuit housed in the package container 12 is cooled to a temperature below 100 K including 100 K which is the operation temperature of the high-frequency circuit.

During the operation of the high-frequency circuit cooled to the operation temperature, temperature changes of the package container 14 due to heating of the high-frequency circuit are detected by the temperature sensor 52 and monitored by the temperature monitor 56.

When a temperature exceeding the limit of the operation temperature of the high-frequency circuit is monitored by the temperature monitor 56, the valve controller 60 opens the electromagnetic valve 32, and helium gas is supplied from the gas supply unit 28 into the tank 16 though the pipes 26, 24.

When helium gas is supplied from the gas supply unit 28 into the tank 16, the helium gas cooled in the tank 16 is introduced into the package container 14 through the pipes 20, 18. The helium gas in the tank 16 has been cooled to a lower temperature than the helium gas in the package container 14, the temperature of which has been raised by heating of the high-frequency circuit. Accordingly, the helium gas in the tank 16 is introduced into the package container 14, whereby the heated high-frequency circuit can be sufficiently cooled. At this time, the valve 40 inserted in the pipe 56 is suitably opened to discharge the helium gas in the package container 14, the temperature of which has been raised.

All or part of the helium gas cooled in the tank 16 is introduced into the package container 14, and the electromagnetic valve 32 is closed when the temperature monitored by the temperature monitor 56 is within the operation temperature range. The helium gas in the tank 16, the temperature of which is raised by the helium gas newly supplied from the gas supply unit 28 is cooled by the cold head 12 to a prescribed temperature.

During the operation of the high-frequency circuit, the cooled helium gas in the tank 16 is thus suitably introduced into the package container 14, whereby the high-frequency circuit can be sufficiently cooled.

After the operation of the high-frequency circuit housed in the package container 14 has been completed, when the high-frequency circuit is replaced and maintained, cooling by the cold head 12 is stopped while the pressure in the vacuum container 10 is returned to the atmospheric pressure. Furthermore, the electromagnetic valve 32 and the valve 40 are opened to thereby flow helium gas from the gas supply unit 28 into the tank 16 and into the package container 14. Thus, the package container 14, the high-frequency circuit housed in the package container 14 and the tank 16 which have been cooled can be raised to the room temperature. Accordingly, after the operation of the high-frequency circuit has been completed, the replacement and maintenance of the high-frequency circuit can be performed in a short time.

FIG. 5A is a graph of the results of power tests made on the high-frequency circuit while the high-frequency circuit is being cooled by the high-frequency circuit cooling apparatus according to the present embodiment.

The high-frequency circuit the power tests were made on was a microstrip resonator (single filter) illustrated in FIG. 5B. That is, the power tests were made on a high-frequency circuit comprising input/output feeders 66*a*, 66*b*, and a disc-shaped resonator pattern 68 sandwiched by the input/output feeders 66*a*, 66*b* which are formed on a magnesium oxide substrate 64. The input/output feeders 66*a*, 66*b* and the resonator pattern 68 are formed of $YBa_2Cu_3O_{7-\delta}$ (YBCO) superconducting film. The diameter of the resonator pattern was 1.4 mm.

In the power tests, the high-frequency circuit illustrated in FIG. 5B described above was housed in the package container 14, and the package container 14 was mounted on the cold head 12 and cooled to the operation temperature of 80 K. With the high-frequency circuit cooled to the operation temperature of 80 K, sine waves of the resonance frequency (4 GHz) were applied to the high-frequency circuit via the high-frequency coaxial cables 44*a*, 44*b*, and output powers of the fundamental wave (the main component of the applied sine wave signals) and the IMD3 (third intermodulation distortion) were measured.

In the graph of FIG. 5A, the input powers Pin (values outside the vacuum container 10) are taken on the horizontal axis, and output powers (values outside the vacuum container 10) are taken on the vertical axis. The plots of the fundamental wave indicated by the ● marks were given by introducing helium gas into the package container 14 by the high-frequency circuit cooling apparatus according to the present embodiment. The plots of the fundamental wave indicated by the ▲ marks were given by placing the interior of the package container 14 in a vacuum spate. The plots of the IMD3 indicated by the ○ marks were given by introducing helium gas into the package container 14 by the high-frequency circuit cooling apparatus according to the present embodiment. The plots of the IMD3 indicated by the Δ marks were given by placing the interior of the package container 14 in a vacuum state.

As evident from the comparison between the plots shown in FIG. 5A, it is found that the breaking down power (handling power) is higher with respect to the values of the high input powers Pin by introducing helium gas into the package container 14 by the high-frequency circuit cooling apparatus according to the present embodiment than by placing the interior of the package container 14 in a vacuum state. It is found that good low distortions of the IMD3 waves with respect to the same values of the input power Pin in introducing helium gas into the package container 14 by the high-frequency circuit cooling apparatus according to the present embodiment than in placing the interior of the package container 14 in a vacuum state.

Based on the above-described power test results, it is confirmed that the high-frequency circuit cooling apparatus according to the present embodiment can sufficiently cool the high-frequency circuit, and the characteristics of the high-frequency circuit can be improved.

As described above, according to the present embodiment, helium gas is introduced into the package container 14 mounted on the cold head 12 and housing a high-frequency circuit, whereby the high-frequency circuit housed in the package container 14 is cooled by the solid heat conduction of the cold head 12 via the package container 14, while being cooled by the heat conduction of the helium gas. Thus, the high-frequency circuit housed in the package container 14 can be sufficiently cooled.

According to the present embodiment, the supply amount of helium gas to be supplied from the gas supply unit 28 into the package container 14 via the tank 16 is suitably controlled, whereby the heat conduction to the high-frequency circuit housed in the package container 14 can be adjusted. Thus, in, e.g., tests, etc. of the high-frequency circuit, the cooling temperature and cooling rate of the high-frequency circuit can be adjusted.

According to the present embodiment, helium gas to be introduced into the package container 14 is stored in the tank 16 mounted on the cold head 12, whereby the helium gas which has been sufficiently cooled in advance by the cold head 12 can be introduced into the package container 14. Accordingly, the high-frequency circuit housed in the package container 14 can be sufficiently cooled in a short time.

According to the present embodiment, the package container 14 is formed of a plurality of members which are mechanically fixed to each other, and is separable into the plural members. Furthermore, the pipes 18, 34 are detachably connected respectively to the package container 14 and detachably connected respectively to the other pipes 20, 36. Accordingly, the pipes 18, 24 and the package container 14 are disconnected from each other, or the pipes 18, 34 and the other pipes 20, 36 are disconnected from each other and the package container 14 is separated into the plural members, which facilitates the high-frequency circuit housed in the package container 14 being replaced and maintained.

Modified Embodiments

The present invention is not limited to the above-described embodiments and can cover other various modifications.

For example, in the above-described embodiments, the gas to be introduced into the package container 14 is helium gas. However the gas to be introduced into the package container 14 is not limited to helium gas. The gas other than helium gas, which is to be introduced into the package container 14 can be an inert gas, such as, e.g., nitrogen gas, argon gas neon gas or others. However, the gas to be introduced into the package container 14 must be composed of materials which are not liquidized or solidified at the cooling temperature for the high-frequency circuit.

In the above-described embodiments, 1 package container 14 is mounted on the cold head 12. However, a plurality of the package containers 14 may be mounted on the cold head 12. In this case, the tanks 16 may be connected to the respective plural package containers 14 in the same manner as described above for storing the gas to be introduced into the respective package containers 14. A plurality of package containers 14 may be connected to 1 tank 16 serially or in parallel via pipes.

In the above-described embodiments, the package container 14 and the tank 16 are mounted on the cold head 12 but may not be mounted essentially on the cold head 12 as long s the package container 14 and the tank 16 are in contact with the cold head 12 to be cooled by the heat conduction.

In the above-described embodiments, as the high-frequency circuit, a transmission superconducting band-pass filter having the pass frequency near 4 GHz is housed in the package container 14. However, the present invention is applicable to cooling any high-frequency circuit operating at low temperatures and any high-frequency circuit which may heat in operations and must be cooled.

In the above-described embodiments, the cold head 12, the package container 14 and the tank 16 are housed in the vacuum container 10 but may not be housed in the vacuum container 10, depending on cooling temperature, etc. of the high-frequency circuit housed in the package container 14.

In the above-described embodiments, the temperature sensor 52 is attached to the package container 14 but may be attached to the substrate of the high-frequency circuit housed in the package container 14. The temperature sensor 52 may be disposed near the package container 14 as long as the temperature of the high-frequency circuit housed in the package container 14 can be directly or indirectly monitored.

What is claimed is:

1. A high-frequency circuit cooling apparatus comprising:

a package container for housing a high-frequency circuit;

a tank for storing a gas to be introduced into the package container;

a cooling unit for cooling the package container and the tank;

a first pipe connected to the tank, for supplying the gas into the tank;

a second pipe detachably connected between the tank and the package container, for introducing the gas in the tank into the package container; and a third pipe detachably connected to the package container, for discharging the gas in the package container, wherein the package container includes a container of ceramics and a metal film formed on a inside wall of the container.

2. The high-frequency circuit cooling apparatus according to claim 1, further comprising a vacuum container accommodating the cooling unit, the package container and the tank.

3. The high-frequency circuit cooling apparatus according to claim 2, wherein the container is formed of alumina, zirconia, partially stabilized zirconia or stabilized zirconia, and the metal film is formed of gold, silver or copper.

4. The high-frequency circuit cooling apparatus according to claim 1, wherein the container is formed of alumina, zirconia, partially stabilized zirconia or stabilized zirconia, and the metal film is formed of gold, silver or copper.

5. A high-frequency circuit cooling apparatus comprising:

a package container for housing a high-frequency circuit;

a tank for storing a gas to be introduced into the package container;

a cooling unit for cooling the package container and the tank;

a first pipe connected to the tank, for supplying the gas into the tank;

a second pipe detachably connected between the tank and the package container, for introducing the gas in the tank into the package container; and a third pipe detachably connected to the package container, for discharging the gas in the package container, wherein a connection between the second pipe and the package container, and a connection between the third pipe and the package container are sealed by metal seals.

6. The high-frequency circuit cooling apparatus according to claim 5, further comprising a vacuum container accommodating the cooling unit, the package container and the tank.

7. A high-frequency circuit cooling apparatus comprising:

a package container for housing a high-frequency circuit;

a tank for storing a gas to be introduced into the package container;

a cooling unit for cooling the package container and the tank;

a first pipe connected to the tank, for supplying the gas into the tank;

a second pipe detachably connected between the tank and the package container, for introducing the gas in the tank into the package container; and a third pipe detachably connected to the package container, for discharging the gas in the package container, wherein the package container and/or the tank are in contact with the cooling unit via a solid medium having heat conductivity.

8. The high-frequency circuit cooling apparatus according to claim 7, further comprising a vacuum container accommodating the cooling unit, the package container and the tank.

9. The high-frequency circuit cooling apparatus according to claim 8, wherein the solid medium is hydrogen carbide grease, indium sheet or graphite.

10. The high-frequency circuit cooling apparatus according to claim 7, wherein the solid medium is hydrogen carbide grease, indium sheet or graphite.

11. A high-frequency circuit cooling apparatus comprising:

a package container for housing a high-frequency circuit;

a tank for storing a gas to be introduced into the package container;

a cooling unit for cooling the package container and the tank;

a first pipe connected to the tank, for supplying the gas into the tank;

a second pipe detachably connected between the tank and the package container, for introducing the gas in the tank into the package container;

a third pipe detachably connected to the package container, for discharging the gas in the package container;

a gas supply unit for supplying the gas into the tank;

a temperature sensor disposed near the package container, for detecting a temperature of a vicinity of the package container; and a control unit for controlling a supply of the gas of the gas supply unit into the tank, based on a result of a detection of the temperature near the vicinity of the package container given by the temperature sensor.

12. The high-frequency circuit cooling apparatus according to claim 11, further comprising a vacuum container accommodating the cooling unit, the package container and the tank.

* * * * *